United States Patent [19]

Kuratani et al.

[11] Patent Number: 4,903,003

[45] Date of Patent: Feb. 20, 1990

[54] VARIABLE RESISTOR WITH A SWITCH

[75] Inventors: Junichi Kuratani; Keizi Takezawa, both of Miyagi, Japan

[73] Assignee: Alps Electric Co., Ltd., Tokyo, Japan

[21] Appl. No.: 139,901

[22] Filed: Dec. 31, 1987

[30] Foreign Application Priority Data

Apr. 28, 1987 [JP] Japan ..... 62-63435[U]

[51] Int. Cl.[4] ..... H01C 10/50

[52] U.S. Cl. ..... 338/198; 338/178; 338/200

[58] Field of Search ..... 338/198, 200, 201, 191, 338/178, 179

[56] References Cited

U.S. PATENT DOCUMENTS

| | | | |
|---|---|---|---|
| 3,497,857 | 2/1970 | Pfeufer | 338/178 |
| 3,633,146 | 1/1972 | Neyagawa et al. | 338/178 |
| 3,858,148 | 12/1974 | Hauenstine | 338/178 |
| 4,523,176 | 6/1985 | Leibinger et al. | 338/198 X |
| 4,660,019 | 4/1987 | Bauer et al. | 338/198 X |

*Primary Examiner*—Teresa J. Walberg

*Assistant Examiner*—M. M. Lateef

*Attorney, Agent, or Firm*—Guy W. Shoup; Stephen L. Malaska

[57] ABSTRACT

A variable resistor with a switch which minimizes appearances of an arc and prevents incomplete contact between contacts of the switch originating from such an arc. The variable resistor with a switch includes a torsion coil spring having one end connected to a movable contact element supported for pivotal motion around a support shaft and the other end connected to a cam member also supported for pivotal motion around the support shaft. When the cam member is pivoted by movement of a slider receiver, a connecting point between the torsion coil spring and the cam member moves across a straight line interconnecting the support shaft and another connecting point between the torsion coil spring and the movable contact element so that a movable contact on the movable contact element is instantaneously brought into or out of contact with a fixed contact to turn the switch on or off irrespective of the speed of movement of the slider receiver.

4 Claims, 9 Drawing Sheets

VARIABLE RESISTOR WITH A SWITCH

BACKGROUND OF THE INVENTION

1. Field of the Invention

This invention relates to a variable resistor with a switch wherein the resistance thereof is adjusted by sliding movement of a slider receiver and a switching operation occurs at a predetermined position of the slider receiver.

2. Description of Prior Art

Variable resistors with a switch are already known wherein the resistance thereof is adjusted by sliding movement of a slider receiver and a switching operation occurs at a predetermined position of the slider receiver.

An exemplary one of such conventional variable resistors with a switch includes a base plate on which a resistance strip and a conductor constituting the switch are disposed in a juxtaposed relationship and a slider receiver to which a slider is secured is mounted for sliding movement covering over the base plate. With the conventional variable resistor with a switch, the resistance thereof is determined or a switching operation thereof occurs in response to a position of the slider relative to the resistance strip and the conductor as the slider receiver is slidably moved.

However, a variable resistor with a switch having such a construction as described just above has a relatively large dimension in its widthwise direction because a resistance strip and a conductor constituting a switch are disposed in a juxtaposed relationship. Accordingly, such a variable resistor with a switch cannot be applied to such a specific application as a car-carried application where there is a spatial limit left for the switch to be allowed to occupy.

Thus, the applicant of the present patent application proposed, in Japanese Utility Model Application No. 60-107570, an electronic component of the slide type which is significantly reduced in dimension in its widthwise direction.

Now, the electronic component of the slide type proposed precedingly by the applicant will be described with reference to FIGS. 10 to 12.

FIG. 10 is a cross sectional view showing construction of essential part of the proposed electronic component, FIG. 11 a perspective view showing construction of a base plate assembly of the proposed electronic component, and FIG. 12 a schematic view illustrating operation of a third switch of the proposed electronic component.

Referring to FIG. 10, a pair of base plates 1 and 2 made of a suitable electrically insulating material are fitted in a pair of upper and lower openings of a housing 3. A pair of shoulders 3*a* are formed on an inner wall adjacent opposite side edges of the housing 3, and a slider receiver 4 is mounted for sliding movement on each of the shoulders 3*a*.

The base plate 1 fitted in a lower portion of the housing 3 has a resistance strip 5 and a collector strip 6 provided on an upper face thereof and extending in a longitudinal direction of the base plate 1. A slider 7 having a pair of spring contacts 7*a* and 7*b* thereon is mounted on reverse faces, that is, lower faces of the slider receivers 4. The spring contacts 7*a* and 7*b* on the slider 7 are normally held in contact with the resistance strip 5 and the collector strip 6, respectively. A pair of terminals not shown are located alongside the base plate 1 and extend in the same direction. The terminals are connected to opposite ends of the resistance strip 5 and also to an end of the collector strip 6, thereby constituting a variable resistor wherein the resistance between the terminals is varied in response to a position of the slider 7.

Meanwhile, as shown in FIG. 11, conductors 9*a*, 9*b* and 11*a*, 11*b* for two switches are provided in a longitudinal direction on a lower face of the base plate 2 fitted in an upper section of the housing 3 by a suitable means such as printing. Provided on an upper face of the slider receiver 4 are another slider 12 having a pair of spring contacts 12*a* and 12*b* provided thereon for sliding movement on the conductors 9*a* and 9*b*, respectively, and a further slider 13 having a pair of spring contacts 13*a* and 13*b* provided thereon for sliding movement on the conductors 11*a* and 11*b*, respectively. Terminals 14*a*, 14*b*, 15*a* and 15*b* are connected to one ends of the conductors 9*a*, 9*b*, 10*a* and 10*b*, respectively, and extend in the same direction with the terminals provided on the base plate 1. The conductors 9*a* and 9*b* and the slider 12 constitute a first switch means wherein an off or open state in which the conductors 9*a* and 9*b* are disconnected from each other occurs when the slider 12 is positioned on an extension line (a left portion in FIG. 11) of the conductor 9*a* which has a smaller extent than the other conductor 9*b*. Meanwhile, a roundabout portion W is formed intermediately of the conductor 11*a* and provides a switch-off region which disconnects the conductors 11*a* and 11*b* from each other when the slider 13 is positioned at the switch-off region, but when the slider 13 is slidably moved farther leftwardly in FIG. 11 than the switch-off region, the conductors 11*a* and 11*b* are connected to each other, thereby constituting a second switch means.

An actuating member 16 for slidably displacing the slider receiver 4 is located at a portion of the upper base plate 2 remote from the conductors, and an operating rod 17 extends uprightly from the actuating member 16. The actuating member 16 is accommodated in a casing 18 fitted on the housing 3. The casing 18 has a guide slot 19 perforated in parallel with the conductors in a top wall thereof, and the operating rod 17 extends upwardly outwards through the guide slot 19 so that the actuating member 16 may be moved manually or by some other means.

Also the base plate 2 has a guide slot 20 perforated therein in parallel with the conductors. The actuating member 16 and the slider receiver 4 are interconnected by a pair of connecting portions which extend through the guide slot 20 so that the slider receiver 4 may be slidably moved by the actuating member 16.

The actuating member 16 is urged downwardly by a spring member 28 which is fitted around the operating rod 17, located on the actuating member 16 and pressed against an inner face of the casing 18 with a spring receiver 29 interposed therebetween. Consequently, a leg rod is contacted under pressure with a recess 27 of the slider receiver 4.

A third switch means is provided on an upper face of the base plate 2. The third switch means is comprised of a pair of spring contacts 30*a* and 30*b* connected to a pair of terminals 29*a* and 29*b*, respectively, as shown in FIG. 12. The spring contacts 30*a* and 30*b* are normally disconnected from each other but are connected when they are pressed by a pressing portion 31 formed on the actuating member 16.

A click spring 34 is accommodated in a receiving recess 33 formed in a side wall of the actuating member 16, and a click ball 32 is received at an end of the click spring 34 and normally urged by the click spring 34 in a direction to project from the receiving recess 33 and engage with one of a plurality of click grooves 34-1, 34-2, . . . formed on a side wall of the casing 18 in a row in a direction of movement of the actuating member 16 thereby to position the actuating member 16 at its moved position.

With the electronic component of the slide type described above, the widthwise dimension can be reduced significantly, and a switching operation where a relatively low current capacity is required can be assigned to the first and second switch means while a switching operation where a relatively high current capacity is required can be assigned to the third switch means.

However, since the current capacity of the third switch means is high, an arc appears readily between the spring contacts 30*a* and 30*b*. Such a tendency is prominent particularly when the operating rod 17 is operated slowly so that switching between the contacts 30*a* and 30*b* occurs slowly. Accordingly, it is a problem that the contacts may readily be abraded resulting in an accident of cutoff of the switch.

SUMMARY OF THE INVENTION

It is an object of the present invention to provide a variable resistor with a switch which minimizes appearances of an arc and prevents incomplete contact between contacts of the switch originating from such an arc.

In order to attain the object, according to the present invention, there is provided a variable resistor with a switch wherein a resistance strip and a collector strip are formed on a resistance base plate while a slider receiver having a slider thereon is mounted for sliding movement on and covers the resistance base plate, the resistance of the variable resistor being determined in accordance with a sliding position of the slider receiver while the switch is actuated to make a switching operation at a predetermined sliding position of the slider receiver, comprising an actuating element located on a side wall of the slider receiver, a switch base plate disposed in an opposing relationship to the side wall of the slider receiver, a fixed contact and a support shaft both provided on the switch base plate, a movable contact element supported for pivotal motion around the support shaft and having a movable contact located thereon for contacting with the fixed contact, a cam member also supported for pivotal motion around the support shaft and located for engagement and actuation by the actuating element, and a torsion coil spring having opposite ends connected to the movable contact element and the cam member such that when the cam member is pivoted, a connecting point at which the torsion coil spring is connected to the cam member may move across a straight line interconnecting the support shaft and another connecting point at which the torsion coil spring is connected to the movable contact element.

With the variable resistor with a switch, when the slider receiver comes to a predetermined sliding position during sliding movement thereof in a first direction, the torsion coil spring is turned over to a first turned over position. Consequently, the movable contact is instantaneously pressed against the fixed contact to turn the switch on. To the contrary, when the slider receiver comes to the predetermined sliding position during sliding movement thereof in a second direction opposite to the first direction, the torsion coil spring is turned over to a second turned over position. Consequently, the movable contact is instantaneously moved away from the fixed contact to turn the switch off. Here, since such an on-off operation of the switch is effected instantaneously making use of a resilient force of the torsion coil spring, an arc seldom occurs between the movable contact and the fixed contact. Accordingly, abrasion of the contacts by appearance of an arc can be reduced, and incomplete contact between the movable contact and the fixed contact can be minimized.

In this manner, a switching operation occurs at the predetermined sliding position of the slider receiver irrespective of the speed of sliding movement of the slider receiver, and a resistance corresponding to a sliding position of the slider receiver can be set.

Further, in structure, the variable resistor and the switch section can be formed as separate bodies and fitted with each other. Accordingly, only by changing the mounting positions of the cam member, the movable contact and the fixed contact of the switch section, variable resistors with a switch which make a switching operation at different desired sliding positions can be selectively produced readily.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
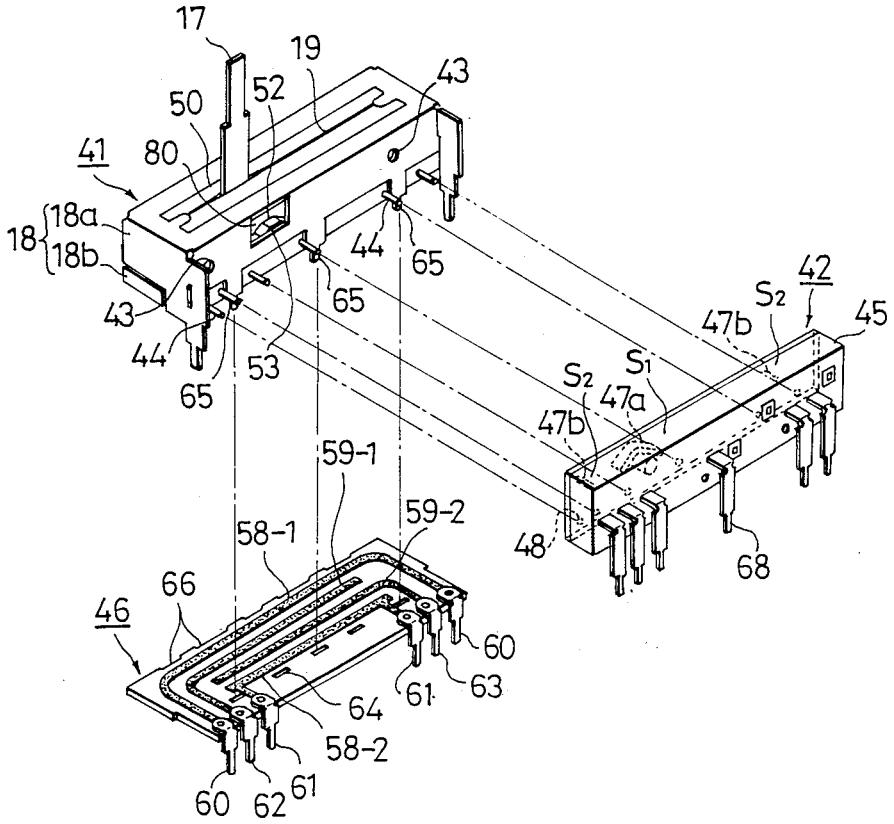
FIG. 1 is a fragmentary perspective view of an entire variable resistor with a switch showing a preferred embodiment of the present invention.

Referring first to FIG. 1, a variable resistor with a switch shown includes a variable resistor section 41 and a switch section 42 which are formed in separate bodies and fitted with each other to form a unitary device. The switch section 42 includes a first switch $S_1$ suitably used for a relatively high current capacity, and two second switches $S_2$ for use for a relatively low current capacity.

In particular, a casing 18 of the variable resistor section 41 has an elongated opening 80 and two operating holes 43 formed in a side wall thereof. Up to 6 fixing pins 44 are fixed to and extend from the side wall of the casing 18.

Meanwhile, an operating element 47*a* for the first switch $S_1$ and two operating elements 47*b* for the two second switches $S_2$ are secured to and extend from a side wall of a casing 45 of the switch section 42. Up to 6 fixing holes 48 are formed on the side wall of the casing 45. Thus, if the variable resistor section 41 and the switch section 42 are assembled to each other with the fixing pins 44 of the casing 18 inserted into the corresponding fixing holes 48 of the casing 45, then the operating elements 47*b* of the second switches $S_2$ are inserted into the corresponding operating holes 43 while the operating element 47*a* of the first switch $S_1$ is inserted into the casing 18 of the variable resistor section 41 through an opening 80 formed in the casing 18.

Figure 2:
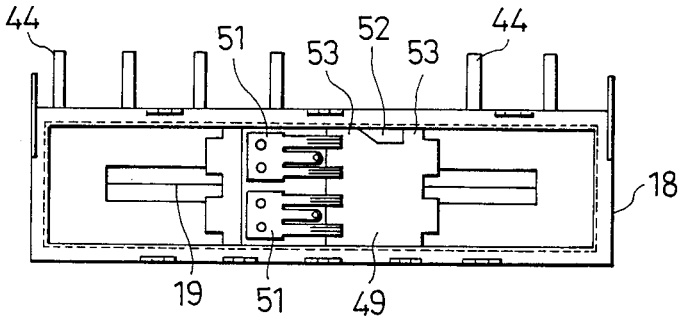
FIG. 2 is a bottom plan view showing internal construction of a variable resistor section with a base plate removed.

The casing 18 of the variable resistor section 41 is comprised of a casing member 18*a* made of a metal and an actuating receiver 18*b* made of a synthetic resin. A step is formed over an entire length between the casing member 18*a* and the actuating receiver 18*b*, and a slider receiver 49 is mounted on the step as shown in FIG. 2.

A guide slot 19 is formed in a longitudinal direction in an upper wall of the casing 18. An operating rod 17 is formed in an integral relationship on the slider receiver 49 and extends upwardly therefrom through the guide slot 19 of the casing 18. A dust proof cover 50 made of a rubber is attached to the upper wall of the casing 18 and has a slit formed therein along the guide slot 19 of the casing 18 for allowing the operating rod 17 to extend through the dust proof cover 50.

Figure 3:
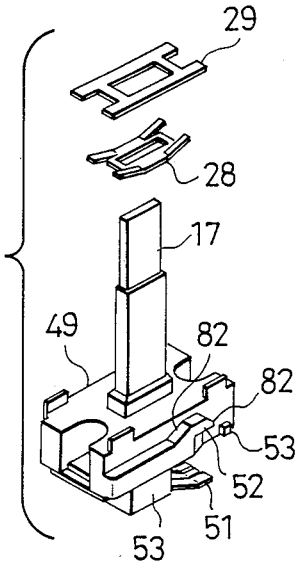
FIG. 3 is a fragmentary perspective view showing construction of a slider receiver.

Referring to FIG. 3, a spring member 28 is located on an upper face of the slider receiver 49 and fitted on the operating rod 17. The spring member 28 is held in contact with an inner wall of the casing 18 with a spring receiver 29 interposed therebetween. The spring receiver 29 may be made of a material having a suitable slipping property such as Teflon. Thus, the slider receiver 49 is disposed in a downwardly pressed condition within the casing 18 so that it may be slidably moved on the casing 18 by operation of the operating rod 17.

Two sliders 51 are located in a juxtaposed relationship on a lower wall of the slider receiver 49. Located in a contiguous relationship on a side wall of the slider receiver 49 opposing to the opening 80 of the casing 18 are two second actuating elements 53 which extend in a predetermined spaced relationship in a direction perpendicular to the side wall of the slider receiver 49, and a first actuating element 52 which is projected upwardly like a mountain.

As particularly seen in FIG. 3, the two second actuating elements 53 are formed substantially at opposite ends of the side wall of the slider receiver 49 in a direction of sliding movement of the slider receiver 49, and the first actuating element 52 is formed in a contiguous relationship to one of the two second actuating elements 53. The first actuating element 52 has a pair of gently tapered faces 82 formed at opposite end portions thereof in the direction of sliding movement of the slider receiver 49.

Figure 4A:
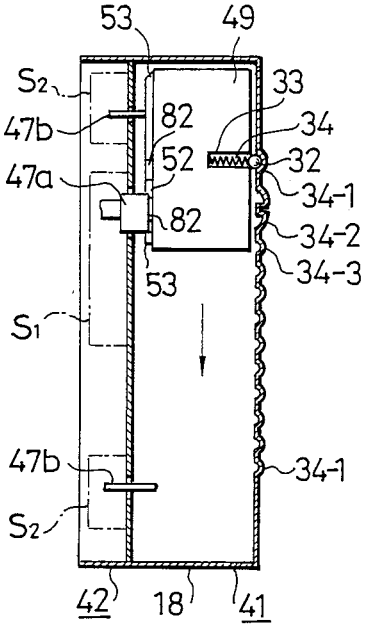
FIGS. 4(A) to 4(D) are schematic views illustrating the principle of a click action.

Referring to FIG. 4(A), a receiving recess 33 is formed in a side wall of the slider receiver 49 opposite to the side wall on which the first and second actuating elements 52 and 53 are formed. A click ball 32 is fitted in the receiving recess 33 of the slider receiver 49 with a click spring 33 interposed therebetween.

The casing 18 has a pair of click grooves 34-1 of a first configuration formed at opposite end portions thereof in the direction of sliding movement of the slider receiver 49, another click groove 34-2 of a second configuration formed inwardly adjacent one of the click grooves 34-1, and up to 8 further click grooves 34-3 of a third configuration formed between the click groove 34-2 and the other one of the click grooves 34-1.

Figures 4B, 4C, 4D:
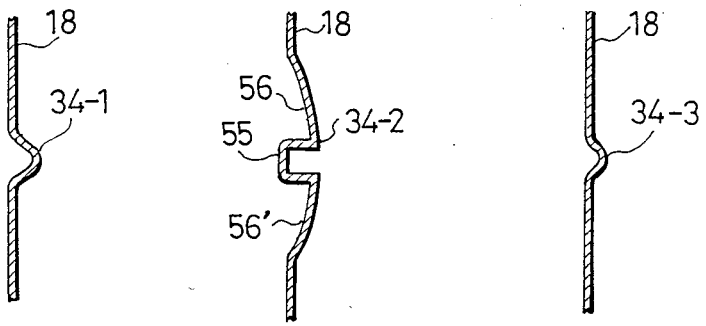

The click grooves 34-1 of the first configuration are each formed as a recess having a substantially semicircular cross section in the wall of the casing 18 as particularly shown in FIG. 4(B). The click groove 34-2 of the second configuration includes, as particularly shown in FIG. 4(C), a protrusion 55 formed in the wall of the casing 18, and a pair of tapered portions 56 and 56' of a same slope formed in opposite directions on opposite sides of the protrusion 55. The slope of the tapered portions 56 and 56', the height and width of the protrusion 55, the diameter of the click ball 32 to be fitted in the click groove 34-2 and the biasing force of the click spring 34 are determined such that when the click ball 32 introduced between one of the tapered portions 56 and the protrusion 55 in one direction is to move in the same one direction, it may move over the protrusion 55 without being fitted into the other tapered portion 56'. Meanwhile, the click grooves 34-3 of the third configuration is formed as a recess having a cross section of part of an arc in the wall of the casing 18 as particularly shown in FIG. 4(D).

Since the click grooves 34-1, 34-2 and 34-3 of the different configurations are formed on the casing 18, when the slider receiver 49 is slidably moved in a downward direction in FIG. 4(A), a click feeling is first obtained at a position at which the click ball 32 is fitted into the uppermost click groove 34-1. When the slider receiver 49 is slidably moved further, the click ball 32 is fitted between the upper side tapered portion 56 of the click groove 34-2 and the protrusion 55 so that a high click feeling will be obtained when the click ball 32 is engaged with the protrusion 55. When the slider receiver 49 is slidably moved further downwardly in FIG. 4 from this position, the click ball 32 is successively fitted, without being fitted into the other tapered portion 56' of the clock groove 34-2, into the 8 click grooves 34-3 at which a light click feeling can be obtained successively. Finally, the click ball 32 is fitted into the lowermost click groove 34-1 also at which a click feeling is obtained.

To the contrary, when the slider receiver 49 is slidably moved upwardly from a downward position in FIG. 4, similar click feelings will be obtained in the reverse order. Particularly at the click groove 34-2, a high click feeling can be obtained when the click ball 32 is fitted between the lower tapered portion 56' and the protrusion 55 and is then engaged with the protrusion 55.

Referring to FIG. 1, a base plate 46 is secured so as to close an opening of the casing 18. The base plate 46 is formed as a substantially rectangular plate and has a pair of collector strips 58-1 and 58-2 and a pair of resistance strips 59-1 and 59-2 formed in parallel to each other in a longitudinal direction on a face thereof. Opposite ends of the collector strip 58-1 are bent toward a same side edge of the base plate 46 and each connected to a terminal 61 at the side edge.

An end of the resistance strip 59-1 is also bent toward the side edge of the base plate 46 and connected to a terminal 62 at the side edge. Also, an end of the resistance strip 59-2 is bent toward the same side edge of the base plate 46 and connected to a terminal 63 at the side edge.

The base plate 46 of such a construction and the casing 18 are fitted with each other with the opening of the casing 18 closed by the base plate 46 such that fixing lugs 65 formed on the casing 18 are securely fitted in respective fixing holes 64 formed in the base plate 46 while fitting lugs not shown formed on the casing 18 are fitted in fitting grooves 66 formed in the base plate 64.

Accordingly, if the operating rod 17 is operated to slide the slider receiver 49 in such a construction as described above, one of the sliders 51 slides in contact with the collector strip 58-1 and the resistance strip 59-1 while the other slider 51 slides in contact with the collector strip 58-2 and the resistance strip 59-2. Thus, resistance values are provided between the terminals 60 and 62 and between the terminals 61 and 63 in accordance with the sliding position of the slider receiver 49.

At the same time, click feelings can be obtained by fitting engagement of the click ball 32 with the click grooves 34-1, 34-2 and 34-3 at predetermined positions of the slider receiver 49 during its sliding movement as described hereinabove.

Now, construction of the switch section 42 of the embodiment of the present invention will be described.

The casing 45 of the switch 42 has a configuration of a substantially parallelepiped. The operating elements **47*a* and 47*b* for the first and second switches are mounted for movement from and to a position in which they extend outwardly from a side wall of the casing 45 while up to 6 switch terminals 68 are led out from the opposite side wall of the casing 45**.

Figure 5:
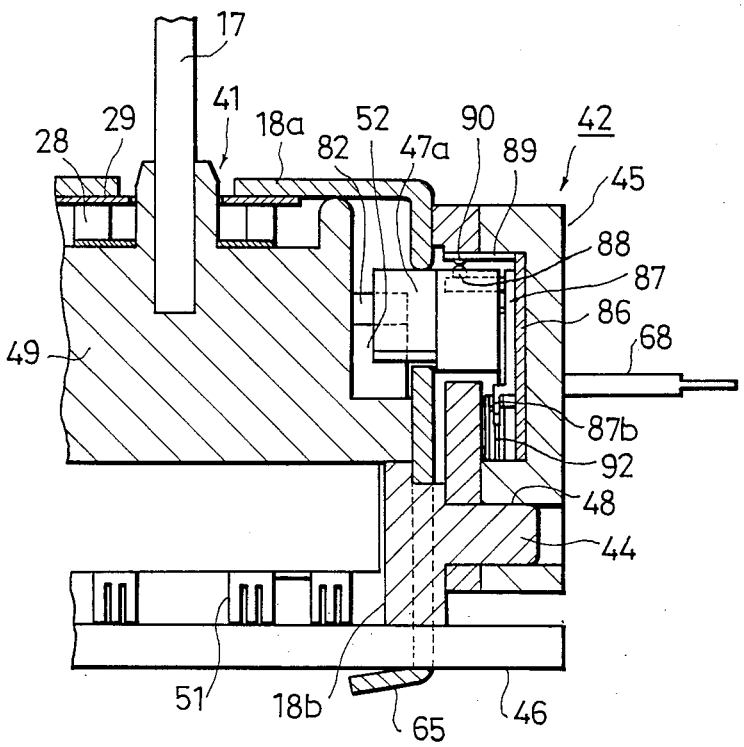
FIG. 5 is an enlarged cross sectional view showing construction of an interconnecting portion between the variable resistor section and a switch section.

As the fixing pins 44 of the variable resistor section 41 are fitted into the corresponding fixing holes 48 of the switch section 42, the first and second operating elements **47*a* and 47*b* of the switch section 42 are inserted into the opening 80 and the operating holes 43, respectively, as described hereinabove. In this manner, the switch section 42 and the variable resistor section 41 are securely fitted with each other as shown in FIG. 5**.

In the embodiment, the second switches $S_2$ located at the opposite ends of the casing 45 of the switch section 42 in the longitudinal direction are used for a relatively low current capacity while the first switch $S_1$ located between the second switches $S_2$ is used for a higher current capacity than the second switches $S_2$.

Figure 6A:
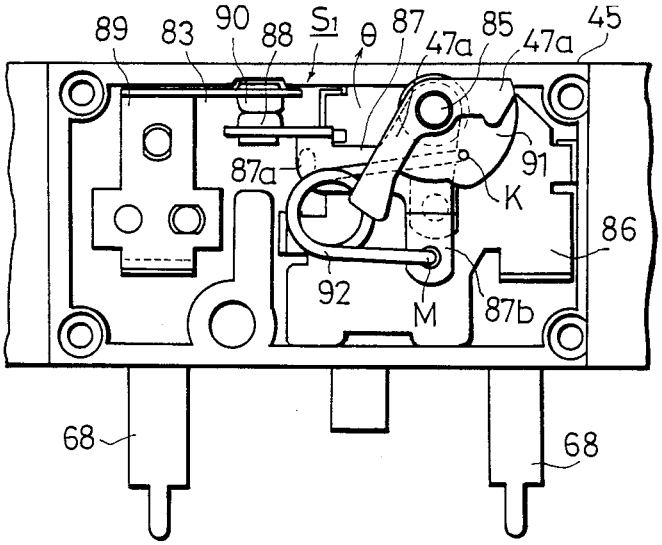
FIGS. 6(A), 6(B) and 6(C) are schematic views illustrating operations of a first switch.
Figure 6B:
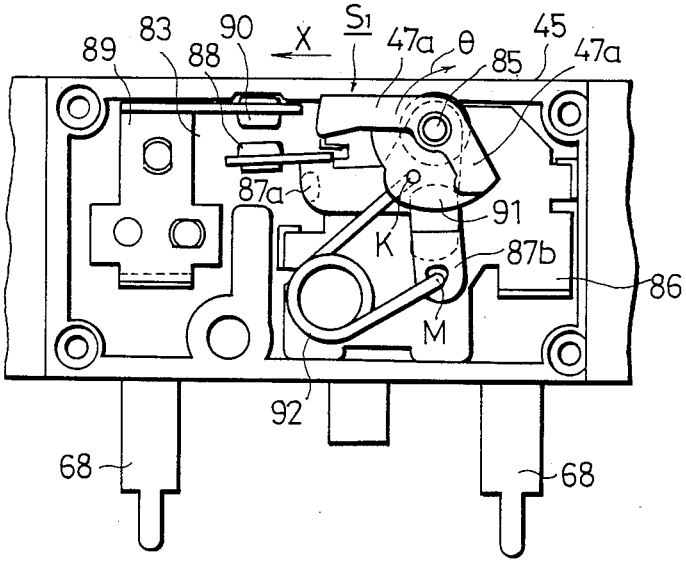
Figure 6C:
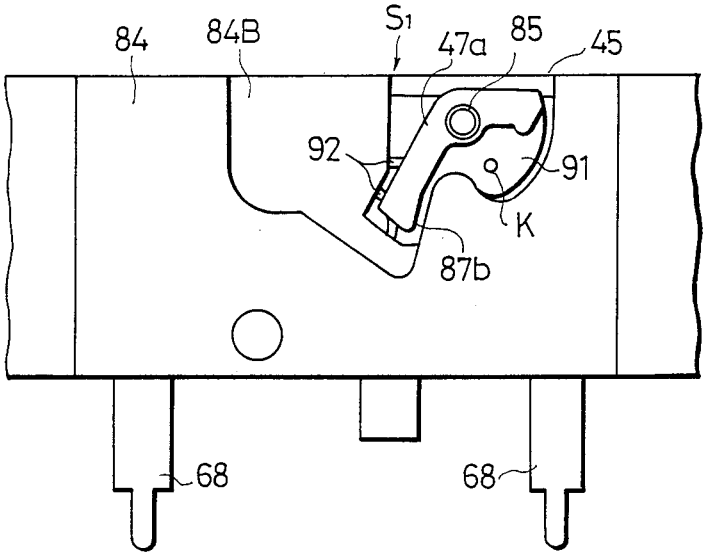

The first switch $S_1$ has such a construction as shown in FIGS. 6(A) and 6(B) and is located in the casing 45 of the switch section 42 and covered by a lid 84 as shown in FIG. 6(C).

In particular, referring to FIG. 6(A), a terminal leading plate 86 of a conducting material is applied to a side plate 83 of the casing 45, and a support shaft 85 is implanted on the side plate 83 and extends through the terminal leading plate 86. A movable contact element 87 is fitted for pivotal motion on the support shaft 85 above the terminal leading plate 86 and has a pair of arms **87*a* and 87*b*** which extend substantially in perpendicular directions to each other.

The arm **87*a* of the movable contact element 87 is bent adjacent an end thereof so as to extend in a perpendicular direction relative to the side plate 83 of the casing 45, and a movable contact 88 is secured to an end of the bent arm 87*a***.

Meanwhile, a fixed contact element 89 is secured to an end portion of the side plate 83 of the casing 45. The fixed contact element 89 is bent adjacent an end thereof so as to extend in a perpendicular direction relative to the side plate 83 and along an upper wall of the casing 45. A fixed contact 90 for contacting with the movable contact 88 is secured to an end portion of the bent fixed contact element 83.

A cam 91 is supported on the support shaft 85 above the movable contact element 87. The operating element **47*a* for the first switch having a substantially L-shape in side elevation is formed at a portion of the cam 91 on the projected end side of the support shaft 85. Opposite ends of the torsion coil spring 92 are anchored at a substantially central location of the cam 91 and an end portion of the arm 87*b* of the movable contact element 87**.

In FIG. 6(A), the torsion coil spring 92 is shown held in a turned over position. At the first turned over position of the torsion coil spring 92, the movable contact 88 is pressed against the fixed contact 90 by the biasing force of the torsion coil spring 92 so that the first switch $S_1$ is held in an off or open condition.

The terminal 68 connected to the fixed contact element 89 and the terminal 68 connected to the terminal leading out plate 86 are led out from the side plate 83 of the casing 45. Accordingly, an on-off signal of the first switch $S_1$ can be taken out between the terminals 68.

If the operating element **47*a* is pivoted in a direction indicated by an arrow mark $\theta$ from the position shown in FIG. 6(A), the cam 91 integral with the operating element 47*a* is also pivoted in the direction $\theta$. Consequently, a connecting point K between the cam 91 and the torsion coil spring 92 is moved in the clockwise direction in FIG. 6(A) around the support shaft 85. When the connecting point K is moved from the right-hand side to the left-hand side in FIG. 6(A) beyond a straight line interconnecting the center of the support shaft 85 and a connecting point M between the arm 87*b* and the torsion coil spring 92**, it will be turned over instantaneously to a second turned over position.

As a result of such turning over of the torsion coil spring 92, the movable contact element 87 is pivoted rapidly in a direction opposite to the direction $\theta$, that is, in the counterclockwise direction so that the movable contact 88 thereon is rapidly moved away from the fixed contact 90 as shown in FIG. 6(B).

The first switch $S_1$ wherein such turning over movement as described above is allowed is covered by the lid 84 in such a condition that the operating element **47*a* thereof is projected outwardly of the casing 45 as shown in FIG. 6(C). The lid 84 has a recessed step 84B formed therein for allowing smooth pivotal motion of the operating element 47*a*. Though not shown, a plurality of pressing elements are formed projectingly in an area of the side plate 83 of the casing 45 on which the lid 84 is located. The lid 84 is thus allowed to cover over the first switch $S_1$ without a play by the pressing elements of the casing 45**.

Figure 8:
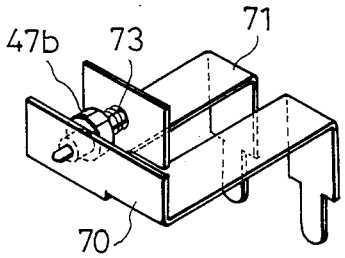
FIG. 8 is a perspective view showing construction of contacts of a second switch.

The second switches $S_2$ have such a construction as shown in FIG. 8. Each of the second switches $S_2$ is located such that the operating element **47*b* thereof may be projected from the side wall of the casing 45 opposing to the variable resistor section 41**.

In the embodiment shown, the second switches $S_2$ are provided one for each of the longitudinal opposite ends of the switch section 42.

Figure 9A:
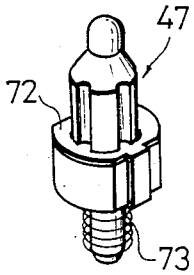
FIGS. 9(A) and 9(B) are perspective views showing construction of an actuating element for the second switch.
Figure 9B:
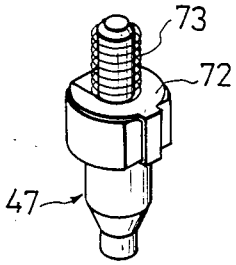
Figure 10:
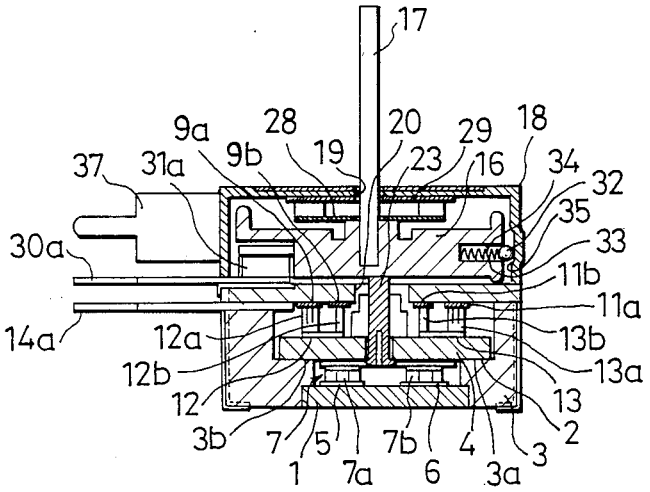
Fig.10 PRIOR ART
FIG. 10 is a vertical sectional view showing a conventional variable resistor with a switch.
Figure 11:
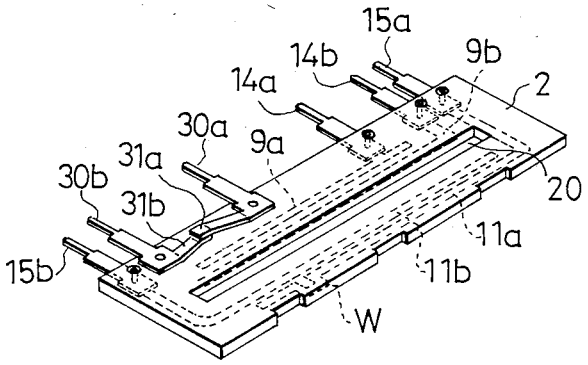
Fig.11 PRIOR ART
FIG. 11 is a perspective view showing construction of a base plate of the variable resistor of FIG. 10.
Figure 12:
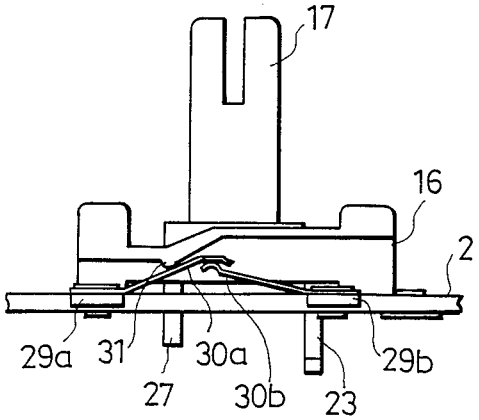
Fig.12 PRIOR ART
FIG. 12 is a schematic view illustrating an operation of a third switch means of the variable resistor of FIG. 10.

The operating element 47b has a greater diameter portion formed behind an end portion thereof as shown in FIGS. 9(A) and 9(B), and a conducting contact 72 is attached to a surface of the greater diameter portion of the operating element 47b. A smaller diameter portion is formed behind the greater diameter portion of the operating element 47b, and a coil spring 73 is fitted around the smaller diameter portion of the operating element 47b and electrically connected to the contact 72.

FIG. 8 shows the second switch $S_2$ in a closed or on condition wherein the operating element 47b is not depressed and consequently is projected at an end portion thereof from the side wall of the casing 45 by the biasing force of the coil spring 73. In this condition, if the slider receiver 49 is slidably moved, the operating element 47b is depressed by a corresponding one of the second actuating elements 53 shown in FIG. 3 so that the contact 72 of the operating element 47b is moved away from the contact element 70, thereby changing over the second switch $S_2$ from a closed or on condition to an open or off condition.

Now, operation of the variable resistor with a switch of the embodiment of the present invention which is obtained by fitting the variable resistor section 41 and the switch section 42 having such constructions as described above with each other will be described.

With the variable resistor with a switch of the embodiment, when it is used, a circuit having a relatively high current capacity may be connected to the first switch $S_1$ and another circuit having a lower current capacity may be connected to either of the second switches $S_2$.

FIG. 4(A) shows the variable resistor section 41 when the slider 49 thereof is positioned at one of opposite ends of the travel of the sliding movement. In the position shown, an upper one in FIG. 4(A) of the second actuating elements 53 depresses the operating element 47b of the corresponding second switch $S_2$ so that the second switch $S_2$ is held in its open condition. To the contrary, the other second switch $S_2$ is held in its closed position because the operating element 47b thereof is not depressed and accordingly is projected therefrom.

Also in the condition shown in FIG. 4(A), the operating element 47a of the first switch $S_1$ is held out of contact with the first actuating element 52 and the torsion coil spring 92 of the first switch $S_1$ assumes the first turned over position as described above so that the movable contact 88 is pressed against the fixed contact 90. Accordingly, the first switch $S_1$ is held in its closed condition.

Figure 7:
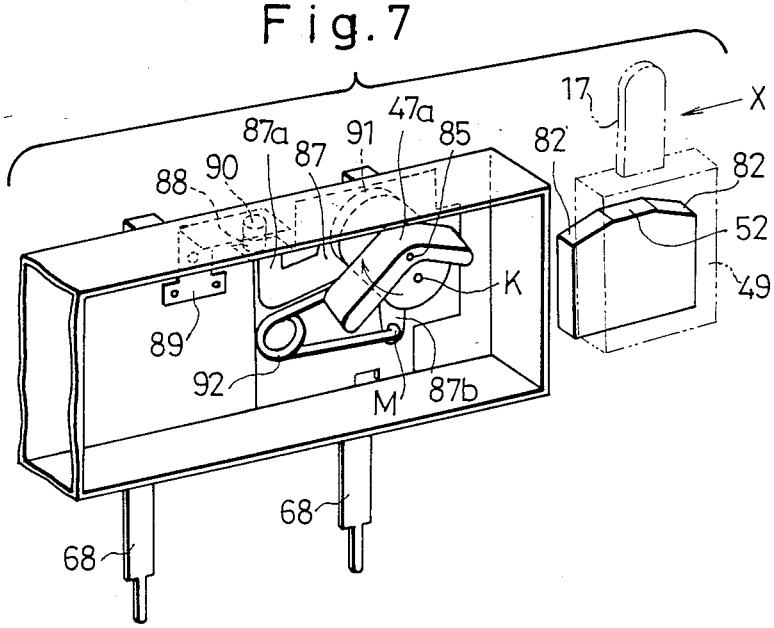
FIG. 7 is a perspective view illustrating an operation of the first switch.

In this condition, if sliding movement of the slider receiver 49 in a second direction indicated by an arrow mark X in FIG. 4(A) is started, the tapered face 82 of the first actuating element 52 will first enter under the operating element 47a of the first switch $S_1$ so that as the sliding movement continues further, the operating element 47a is pivoted in a direction indicated by an arrow mark $\theta$ in FIG. 7, that is, in the clockwise direction by the tapered face 82.

As the operating element 47a is pivoted, the cam 91 is pivoted, and thus when the connecting point K between the cam 91 and the torsion coil spring 92 moves across the straight line interconnecting the center of the support shaft 85 and the connecting point M between the arm 87b of the movable contact element 87 and the torsion coil spring 92, the torsion coil spring 92 is instantaneously turned over to the second turned over position. As a result of such turning over of the coil spring 92, the movable contact 88 is quickly moved away from the fixed contact 90, bringing the first switch $S_1$ into its open condition.

It is to be noted that, in the embodiment shown, depression of the operating element 47b of the second switch $S_2$ at the the one end of the travel by the corresponding second actuating element 53 is canceled to turn the second switch $S_2$ on just before the first switch $S_1$ is turned off. Further, with the variable resistor with a switch of the embodiment described, when the first switch $S_1$ is turned off, the click ball 32 is fitted into the click groove 34-2 so that a relatively high click feeling is obtained.

As sliding movement of the slider receiver 49 in the direction of the arrow mark X continues further, a light click feeling or feelings will be obtained by the click ball 32 fitted into one or successive ones of the click grooves 34-3 while the second switch $S_2$ at the one end of the travel is held in its on or closed condition and the first switch $S_1$ is held in its off or open position. At any of such positions of the click grooves 34-2, a resistance corresponding to the position is provided.

As sliding movement of the slider receiver 49 in the second direction is proceeded further, a relatively high click feeling will be obtained by the click ball 32 fitted into the click groove 34-1 at the position at the opposite end of the travel of sliding movement of the slider receiver 49. At this position of the slider receiver 49, the operating element 47b of the second switch $S_2$ at the other end of the travel is depressed by the second actuating element 53 at the lower location in FIG. 3 formed on the slider receiver 49. Accordingly, the second switch $S_2$ assumes its off or open condition.

If the slider receiver 49 is positioned at the other end of its travel remote from its position shown in FIG. 4(A), the second switch $S_2$ at the one end of the travel assumes its on position while the second switch $S_2$ at the other end of the travel assumes its off position, and the first switch $S_1$ assumes its off position.

Then, if the slider receiver 49 is slidably moved in the one direction opposite to the direction of the arrow mark X in FIG. 4(A), at first the second switch $S_2$ at the other end of the travel is turned on in a quite similar manner, and then the torsion coil spring 92 of the first switch $S_1$ is turned over to the first turned over position so that the movable contact 88 is rapidly pressed against the fixed contact 90 to turn the first switch $S_1$ on. Finally at the end position of the travel of sliding movement of the slider receiver 49 at the upper location in FIG. 4(A), the second switch $S_2$ located thereat is turned off.

In the embodiment of the present invention, since the first switch $S_1$ makes a quick switching operation upon turning over of the torsion coil spring 92, even if the sliding speed of the slider receiver 49 is low, an arc seldom occurs between the movable contact 88 and the fixed contact 90. Consequently, the first switch $S_1$ makes a switching operation always at the same sliding position of the slider receiver 49. Accordingly, a switch which operates with a high degree of accuracy can be realized. Further, since an arc seldom appears, possible abrasion of contacts and incomplete contact between contacts resulting from such an arc can be reduced.

Further, from a structural point of view, the variable resistor section 41 and the switch section 42 are constituted as separate bodies, and the variable resistor with a switch is assembled by fitting the fixing pins 44 of the variable resistor section 41 into the fixing holes 48 of the switch section 42. Accordingly, production and assembly of a variable resistor with a switch can be effected efficiently.

Besides, only by changing the position of the switch to be mounted on the variable resistor section 41, a variable resistor with a switch wherein a switching operation can be made at a desired sliding position of the slider receiver 49 can be selectively produced. Accordingly, a variable resistor with a switch can be used for various applications.

It is to be noted that while in the embodiment described above the second switches $S_2$ are located at the opposite ends of the travel of the slider receiver 49 on opposite sides of the first switch $S_1$, the present invention is not limited to such a specific arrangement and various modifications or alterations are possible. For example, a variable resistor with a switch may include only a first switch $S_1$, or may include a first switch $S_1$ located at an end of the travel of a slider receiver 49 and a second switch $S_2$ located next to the first switch $S_1$.

What is claimed is:

1. A variable resistor with a switch wherein a resistance strip and a collector strip are formed on a resistance base plate while a slider receiver having a slider thereon is mounted for sliding movement on and covers said resistance base plate, the resistance of said variable resistor being determined in accordance with a sliding position of said slider receiver while said switch is actuated to make a switching operation at a predetermined sliding position of said slider receiver, comprising an actuating element located on a side wall of said slider receiver, a switch base plate disposed in an opposing relationship to said side wall of said slider receiver, a fixed contact and a support shaft both provided on said switch base plate, a movable contact element supported for pivotal motion around said support shaft and having a movable contact located thereon for contacting with said fixed contact, a cam member also supported for pivotal motion around said support shaft and located for engagement and actuation by said actuating element, and a torsion coil spring having opposite ends connected to said movable contact element and said cam member such that when said cam member is pivoted, a connecting point at which said torsion coil spring is connected to said cam member may move across a straight line interconnecting said support shaft and another connecting point at which said torsion coil spring is connected to said movable contact element.

2. A variable resistor with a switch according to claim 1, wherein a first actuating element and a pair of second actuating elements are provided in a juxtaposed relationship with a predetermined distance left therebetween on said side wall of said slider receiver opposing to a casing, said first actuating element being projected upwardly like a mountain while said second actuating elements extend in a perpendicular direction relative to said side wall of said slider receiver.

3. A variable resistor with a switch, comprising a variable resistor section including a casing having a side wall in which a rectangular opening and two operating holes are formed, said variable resistor section further including a plurality of fixing pins which are formed on and extend from said side wall of said casing, and a switch section including a casing having a side wall in which a plurality of fixing holes are formed corresponding to said fixing pins of said casing of said variable resistor section, a first switch having an operating element thereon and two second switches each having an operating element thereon, said operating elements of said first and second switches being located on and extending from said side wall of said casing of said switch section, whereby as said fixing pins are inserted into the corresponding fixing holes, said operating elements of said second switches are inserted into the corresponding operating holes while said operating element of said first switch is inserted into said casing of said variable resistor section through said opening of said variable resistor section thereby to unite said variable resistor section and said switch section with each other.

4. A variable resistor with a switch according to claim 3, wherein said second switches are located at opposite longitudinal ends of said casing of said switch section and used for a relatively low current capacity while said first switch is located between said second switches and used for a higher current capacity.

* * * * *